United States Patent [19]

Looser

[11] 4,394,917

[45] Jul. 26, 1983

[54] SEALED CLOSURE-CONTAINER PACKAGE

[75] Inventor: Christian Looser, Lutzenberg, Switzerland

[73] Assignee: Alcan International Limited, Montreal, Canada

[21] Appl. No.: 344,005

[22] Filed: Jan. 29, 1982

[30] Foreign Application Priority Data

Feb. 3, 1981 [CH] Switzerland ..... 721/81

[51] Int. Cl.[3] ..... B65D 81/36

[52] U.S. Cl. ..... 215/232; 53/419; 53/478; 206/217

[58] Field of Search ..... 53/419, 478; 215/232; 206/217

[56] References Cited

U.S. PATENT DOCUMENTS 2,298,480 10/1942 Harvey ..... 215/232 X
2,373,847 4/1945 Osborne et al. ..... 215/232
3,475,243 10/1969 Scalora ..... 53/478 X

*Primary Examiner*—Donald F. Norton
*Attorney, Agent, or Firm*—Cooper, Dunham, Clark, Griffin & Moran

[57] ABSTRACT

A sealed package comprising a container, intended for use or reuse as a drinking vessel, and a cover. The container has a cylindrical surface adjacent its mouth to receive a length of tape which, on one side, carries a layer of pressure sensitive adhesive, which can be peeled from the container without leaving objectionable residues. The tape carries a layer of heat-sealable material on its opposite face and this is heat sealed to an aluminium foil lid, also bearing a coating of a heat sealing material.

7 Claims, 1 Drawing Figure

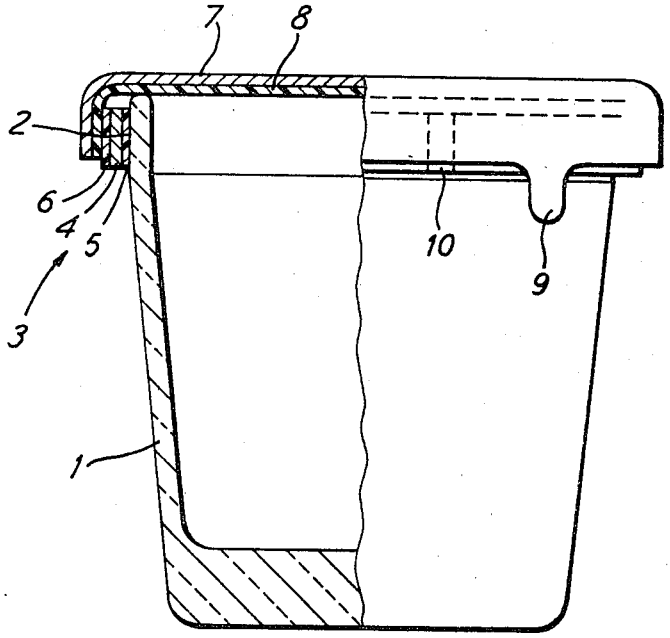
7
8
2
6
4
5
3
10
9
1

SEALED CLOSURE-CONTAINER PACKAGE

The present invention relates to a packaging system for foods and beverages.

It is already well known to pack foods and beverages such as fruit juice and other substances such as pharmaceutical products in glass and like containers, which do not consist of a heat-sealable material or carry a surface layer of heat-sealable material.

It is already well known to close off a glass foodstuffs container by means of a thin foil, such as aluminium foil, which is heat sealed over the mouth of the container by means of a heat-softenable adhesive or lacquer layer carried by the aluminium foil.

This known system has the advantage of being very simple but has the disadvantage that the residues of the adhesive (and sometimes residues of the foil) on the top of the container make it inconvenient to drink contents when liquid direct from the container or to reuse the container subsequently as a drinking vessel without scraping off such residues.

It is an object of the present invention to provide a simple container-closure system which allows a foil lid or cover to be removed in a very simple way and allows the container to be made ready for use or reuse as a drinking vessel without any special cleaning or scraping of the container. For acceptable use as a drinking vessel it is essential that the container does not carry residues which are uncomfortable and unhygienic when contacted by the human lip. For the same reason it is essential that the external surface of the container should be smooth at the location where it would be contacted by the lip of the user and for that reason the external surface of the container should be free of external ribs or screw-threads in the region adjacent the top margin of its side wall.

It has not been practicable to seal a foil cover to glass or similar material by means of a conventional hot melt sealing adhesive without leaving residues on the glass when the aluminium foil lid is removed from the glass.

It has now been found possible to achieve the desired result by applying a strip of tape-like material, bearing a selected pressure sensitive adhesive to an essetially cylindrical external surface adjacent the mouth of the container so as to form a complete ring thereabout and to heat seal an aluminium foil cover to such ring by means of a heat-sealable material carried on such tape-like material and/or on said aluminium foil cover. Preferably the heat-sealable material is carried by both the tape-like ring and the foil cover. It is essential that the container surface in the region, to which the strip is applied, be approximately cylindrical to avoid the formation of wrinkles on the tape. This simple arrangement permits the foil cover to be torn off in the usual way and then the tape-like ring can be peeled off the container neck.

There are available pressure sensitive adhesives which can be peeled off glass without leaving objectionable residues and which are at the same time adequately resistant to penetration by aqueous liquids so as to avoid seepage of the contents of the package between the tape ring and the container surface.

It will be realised that the tape-like material, forming the ring, must also be resistant to penetration by the contents of the package and furthermore that the heat-sealable materials, carried on its opposite surface, must be selected for easy separation from the pressure sensitive adhesive, when drawing off a length of such tape-like material from a roll. Alternatively it must be coated with a separation medium.

Machinery for applying foil lids to containers are well known and involve crimping a flat disc of foil around the top of the container. In the course of such application the peripheral edge of the foil may become pleated and crinkled, so that it is necessary to fuse a heat sealing material coating on the foil for the purpose of bonding the cover to the container and also for sealing up any pleats in the periphery of the cover.

The drawing shows an elevational view of a package of the invention with a portion cut away.

Referring now to the accompanying drawing the container 1 has a substantially cylindrical surface 2. The remainder of the vessel may be of any desired profile although there should be no outward projection in the immediate vicinity of the surface 2. A composite tape 3 is applied to the surface 2 to form a complete ring around such surface. The tape 3 has a central web 4, formed of a material essentially resistant to water and carries a layer 5 of a suitable pressure sensitive adhesive on one surface and a layer 6 of a heat-sealable material on its opposite surface. The tape ring is applied to the container before filling. An appropriate length of tape may be applied to the container by cutting a length of tape of appropriate length and pressing it against the cylindrical surface on the container while the container is rotated by means of rollers, which grip the inside and external surfaces of the container neck. In that way the length of tape is progressively applied to the cylindrical surface by the forces applied by the driving rollers so that the pressure sensitive adhesive is adhered to the neck under optimum conditions.

The pressure sensitive adhesive must satisfy the following conditions:

(i) it should leave no disagreeable residue when peeled off the vessel, (ii) it should be satisfactorily resistant to aqueous liquid contents of the vessel, (iii) it should be resistant to such heat as may be applied to the container in the course of sterilisation, pasteurisation or hot filling.

One pressure sensitive adhesive which is satisfactory for most operations of this type is sold by Monsanto Company under the same "Gelva", but other pressure sensitive adhesives of adequate properties are commercially available and form no part of the present invention.

The central web or core 4 of the composite tape is preferably formed of aluminium foil, although it may be formed of any flexible tape-like material which is satisfactorily resistant to the contents of the package and to the processing conditions mentioned above and also to the heat-sealing conditions. Other possible materials are polyethylene terephthalate, polyamide, polypropylene, high density polyethylene. Plastic-impregnated papers or textiles may be used for the same purpose.

As already indicated the web 4 carries a layer 6 of a heat-sealable material on its other surface. This layer 6 is desirably non-tacky at normal temperature so that it does not adhere to the pressure sensitive adhesive when the composite tape is coiled. Examples of materials that may be used as the heat-sealable material are PVC, polypropylene and polyethylene. The selected heat-sealable materials should have a lower melting point than the central web, although it may in some circumstances be a substance which is fused by microwave energy under conditions which do not fuse plastic tape forming the central web.

The package is closed by a cover 7, made of aluminium foil and bearing a heat-sealable material layer 8, preferably the same heat-sealable material as is employed in the layer 6. The cover 7 is stamped out of a sheet of foil as a flat disc, which is then placed over the container and is folded down at the edges and heat sealed using known lidding machinery.

In some instances it is possible to eliminate either the layer 6 or the layer 8, but that is not a preferred arrangement.

The cover or lid 7 preferably includes a tab 9 to assist removal. The composite tape strip 3 is also preferably provided with a tab 10 or other means, such as a transverse score, to allow it to be manually grasped to assist removal from the vessel.

I claim:

1. Sealed package for use or reuse as a drinking vessel comprising a container having an essentially cylindrical surface adjacent the container mouth, a ring, formed of a length of tape-like material, adhered to said cylindrical surface by means of a layer of pressure sensitive adhesive carried by said tape-like material, said pressure sensitive adhesive being selected to be peelable from said container surface without leaving objectionable residues thereon, and a foil cover secured to said ring by means of a heat-sealable material.

2. Sealed package according to claim 1 in which the cover is made of aluminium foil.

3. Sealed package according to claim 1 or 2 in which the ring of tape-like material is formed of aluminium foil, bearing a coating of said pressure sensitive adhesive on one surface.

4. A method of producing a sealed package comprising applying a length of tape-like material bearing a layer of a liquids-resistant pressure-sensitive adhesive on one surface, to an essentially cylindrical surface adjacent the mouth of a glass container, said length being sufficient to completely surround said cylindrical surface, filling said container, placing an aluminium foil disc over the mouth of the filled glass container, folding down the edge of the disc around the mouth of the container to contact said length of tape-like material and sealing it to said length by means of a heat-sealable material under conditions of heat and pressure.

5. A method according to claim 4 in which said length of tape-like material carries a layer of heat-sealable material on its other face.

6. A method according to claim 5 in which said aluminium foil disc bears a coating of heat-sealable material on one surface for sealing with the heat-sealable material on said length of tape-like material.

7. A method according to claim 5 in which said tape-like material is aluminium foil.

* * * * *